US006145964A

United States Patent [19]

Peter

[11] Patent Number: 6,145,964

[45] Date of Patent: Nov. 14, 2000

[54] CONTRAGRAPHY APPARATUS HAVING AN ELECTRODE ARRANGEMENT USEFUL FOR CONTRAGRAPHY PRINTING

[75] Inventor: Günter Jakob Peter, Plons, Switzerland

[73] Assignee: Pelikan Produktions AG, Egg, Switzerland

[21] Appl. No.: 08/945,061

[22] PCT Filed: Apr. 18, 1996

[86] PCT No.: PCT/CH96/00143

§ 371 Date: Mar. 9, 1998

§ 102(e) Date: Mar. 9, 1998

[87] PCT Pub. No.: WO96/33072

PCT Pub. Date: Oct. 24, 1996

[30] Foreign Application Priority Data

Apr. 19, 1995 [CH] Switzerland ..... 1123/95

[51] Int. Cl.[7] ..... B41J 2/06

[52] U.S. Cl. ..... 347/55

[58] Field of Search ..... 347/55, 103, 141, 347/151, 154, 111, 159; 399/271, 290, 292, 293, 294, 295

[56] References Cited

U.S. PATENT DOCUMENTS

| | | | |
|---|---|---|---|
| 4,568,955 | 2/1986 | Hosoya et al. . | |
| 4,777,500 | 10/1988 | Salmon | 347/55 |
| 4,958,172 | 9/1990 | McCallum et al. . | |
| 5,477,250 | 12/1995 | Larson . | |
| 5,648,805 | 7/1997 | Keefe et al. | 347/55 |

FOREIGN PATENT DOCUMENTS

| | | |
|---|---|---|
| 34 11 948 A1 | 3/1984 | Germany . |
| 43 38 992 A1 | 5/1994 | Germany . |
| 55-064255 | 5/1980 | Japan . |
| 59-049568 | 3/1984 | Japan . |
| 63-270155 | 8/1988 | Japan . |
| 5185645 | 7/1993 | Japan . |
| 2 218 048 | 8/1989 | United Kingdom . |

*Primary Examiner*—John Barlow
*Assistant Examiner*—Raquel Yvette Gordon
*Attorney, Agent, or Firm*—Fay, Sharpe, Fagan, Minnich & McKee, LLP

[57] ABSTRACT

The electrode arrangement (1) consists of a dielectric substrate (2) on which there are several electrodes (4) with terminal leads. A dielectric layer (6) extends over the electrodes (4) over which there is a screening electrode (7) with an aperture (8) for each of the electrodes (4). The arrangement is especially suitable for a contragraphy apparatus. It can be economically produced.

9 Claims, 3 Drawing Sheets

CONTRAGRAPHY APPARATUS HAVING AN ELECTRODE ARRANGEMENT USEFUL FOR CONTRAGRAPHY PRINTING

BACKGROUND OF THE INVENTION

The invention pertains to the art of printing and, more particularly, to an electrode arrangement and contragraphy instrument.

An example of contragraphy process is disclosed in DE-OS 34 11 948. In the contragraphy process, an electrical field is developed through the paper, between the developer surface, which transports a thin layer of electrically charged toner particles, and suitable print electrodes. The respective print electrode develops the required drawing field. If the electrical field force is strong enough at the location of the developer surface in order to overcome the adhesive power of the toner, the toner is torn off at that location and accelerated in the direction of the paper. The shape of the reproduction of the toner on paper is basically determined by the spatial shape and force of the electrical field between print electrode and developer surface. A description is given in DE-OS 34 11 948 of the utilization of one or several, vis-a-vis the developer surface, vertically oriented needles of electrically conducting material (metal). In order to ensure appropriate through-put during the contragraphy process, several print electrodes must operate simultaneously. For example, for printing of DIN A 4 format pages with a resolution of 200 dpi on a page-at-a-time printer, 1654 of such print electrodes are needed.

With this type of matrix of print electrodes, it is, however, difficult to guarantee accurate position of electrodes to each other. Mass production of such an array of electrodes combined with difficulty in automated contacting of individual electrodes is the reason why contragraphy printing in this form has not as yet been able to establish itself on the market.

SUMMARY OF THE INVENTION

It is an object of the present invention to provide an electrode arrangement for use in contragraphy printing, which can be produced at favorable costs. Said object is achieved by the combination of characteristics of the present invention.

In the electrode arrangement according to the present invention, methods of industrial thin layer technology are employed which permit trouble-free control of combinations of electrically conducting and electrically isolating microstructures with a resolution of up to the $\mu$-range. Particularly suitable as carriers for the electrode structure are thin polymer foils, which can be structurally coated by the so-called "in-line-process". Normal conductor plates, which are, for example, structurally coated by the flow-solder method, can also be used. Representation of conductor paths with individual diameters of up into the $\mu$-range is state of the art. So, preferably circularly-shaped electrodes can, from a production-engineering aspect, beneficially be electrically contacted. Contacting should preferably occur in the same plane. Available processes are, for example: wire-bonding, dye-bonding or the hot-weld process.

Still other advantages and benefits of the invention will become apparent to those skilled in the art upon a reading and understanding of the following detailed description.

BRIEF DESCRIPTION OF THE DRAWINGS

The following are exemplary embodiments of the invention, which will be described in detail in this specification and illustrated in the accompanying drawings which form a part hereof, wherein.

DETAILED DESCRIPTION OF THE PREFERRED EMBODIMENT

Figure 1:
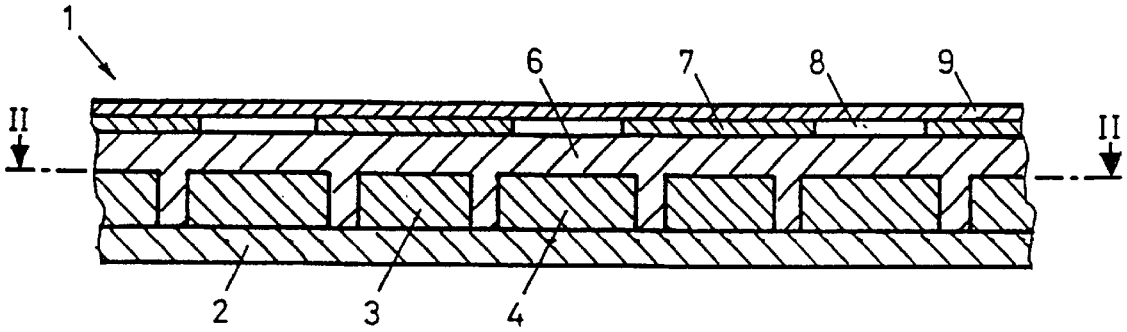
FIG. 1 shows a cross-section through an electrode arrangement.

Referring now to the drawings wherein the showings are for the purposes of illustrating the preferred embodiment of the invention only and not for purposes of the limiting same.

Figure 2:
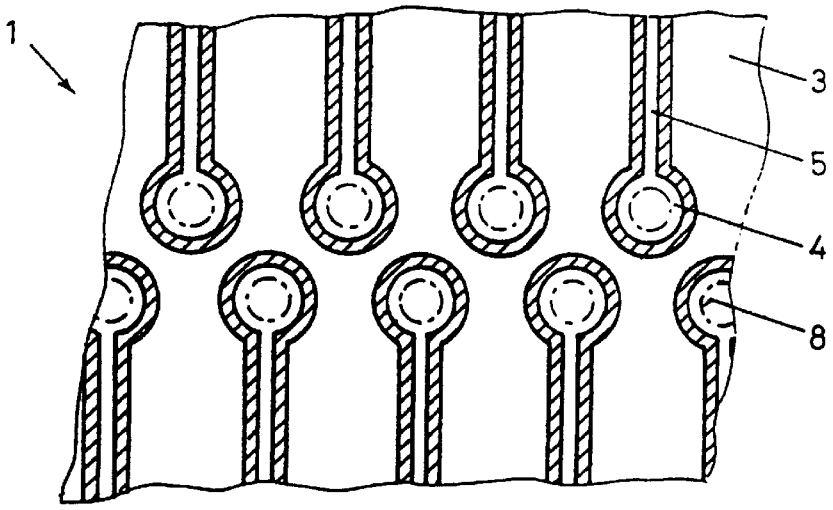
FIG. 2 shows a section along lines II—II in FIG. 1.
Figure 3:
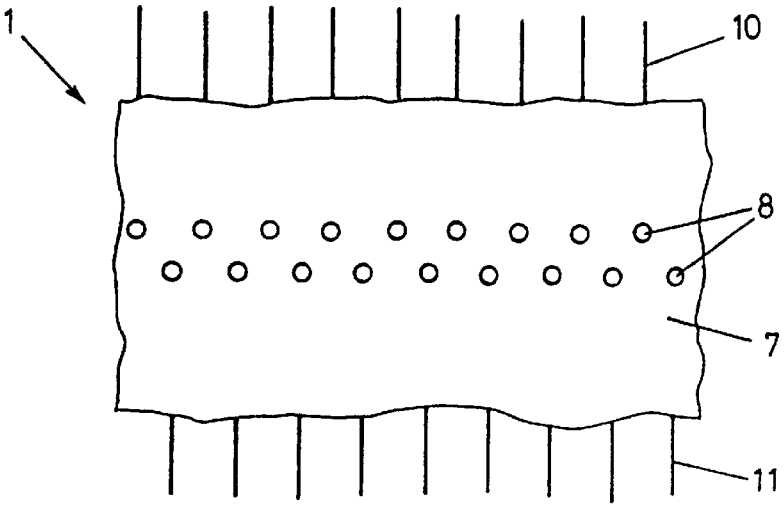
FIG. 3 shows a top view of the arrangement in FIG. 1.

The electrode arrangement 1 according to FIGS. 1–3 is constructed on a dielectric carrier foil 2. Foil 2 can consist for example of a polymer, for example of polyethylene. First a thin metal layer 3 is applied to foil 2, which preferably is thinner than 10 $\mu$m. From the metal layer there is now formed a multitude of circular electrodes 4 with conductors 5 connected therewith, by removal via etching of the areas indicated in hatched fashion in FIG. 2. The remaining rest of the metal layer 3 forms a continuous screening electrode, which effectively screens off the closely arranged adjacent electrodes 4. The leaving in place of the screening electrode 3 has the added benefit that during etching only the hatched area in FIG. 2 must be removed by means of etching, in other words, only a small amount of etching solution is used. Above electrodes 4, conductor 5 and screening electrode 3 there is applied a dielectric layer 6, which also fills out the spaces between the electrodes 4 and conductors 5 and the screening electrode 3. Layer 6 preferably consists of polyethylene because of its high electrical disruptive field force of 7.5 E 7 V/m (75 million volts per meter). Above this layer 6 there is arranged a continuous metal shield grid 7, which has a circular opening 8 above each electrode 4, whose diameter is smaller than the diameter of the respective electrodes 4. As a result, requirements relative to precision of position and shape of electrodes 4 are low. Determining factors with respect to precision are only position and diameter of the openings 8 in the shield grid 7. The thickness of the shield grid can be very small, for example less than 10 $\mu$m. The shield grid 7 makes sure that electrical fields between the electrode arrangement 1 and a developer device for transfer of toner onto an information carrier, for example paper, can only be constructed via the openings 8. The electrical charge of conductors 5 has, in fact, no influence on the reproduction process. The electrical field of conductors 5 is screened off against the developer surface. The thickness of the layer 6 above the electrodes 4, conductors 5 and the screening electrode 3 is as thin as possible, preferably less than 50 $\mu$m, but it is, in any event, sufficiently thick that no reciprocal arcing-over can occur between the electrodes 4 and the shield grid 7. There may be also be arranged above the shield grid 7, a dielectric thin protective film 9, in order to protect the shield grid 7 from mechanical damage.

The array of electrodes 4, conductors 5 and the shield grid 7 can initially also be produced on two different carriers and subsequently, isolated by a thin polymer foil, glued together. The dielectric layer 6 below the opening 8 can be removed or omitted during the manufacturing process. FIG. 3 depicts a bird's eye view of the electrode array 1. Each conductor 5 is connected to a separate electrical line 10, for example by means of wire-bonding, dye-bonding or the hot-weld process. An additional line 11 is connected to the shield grid 7.

Figure 4:
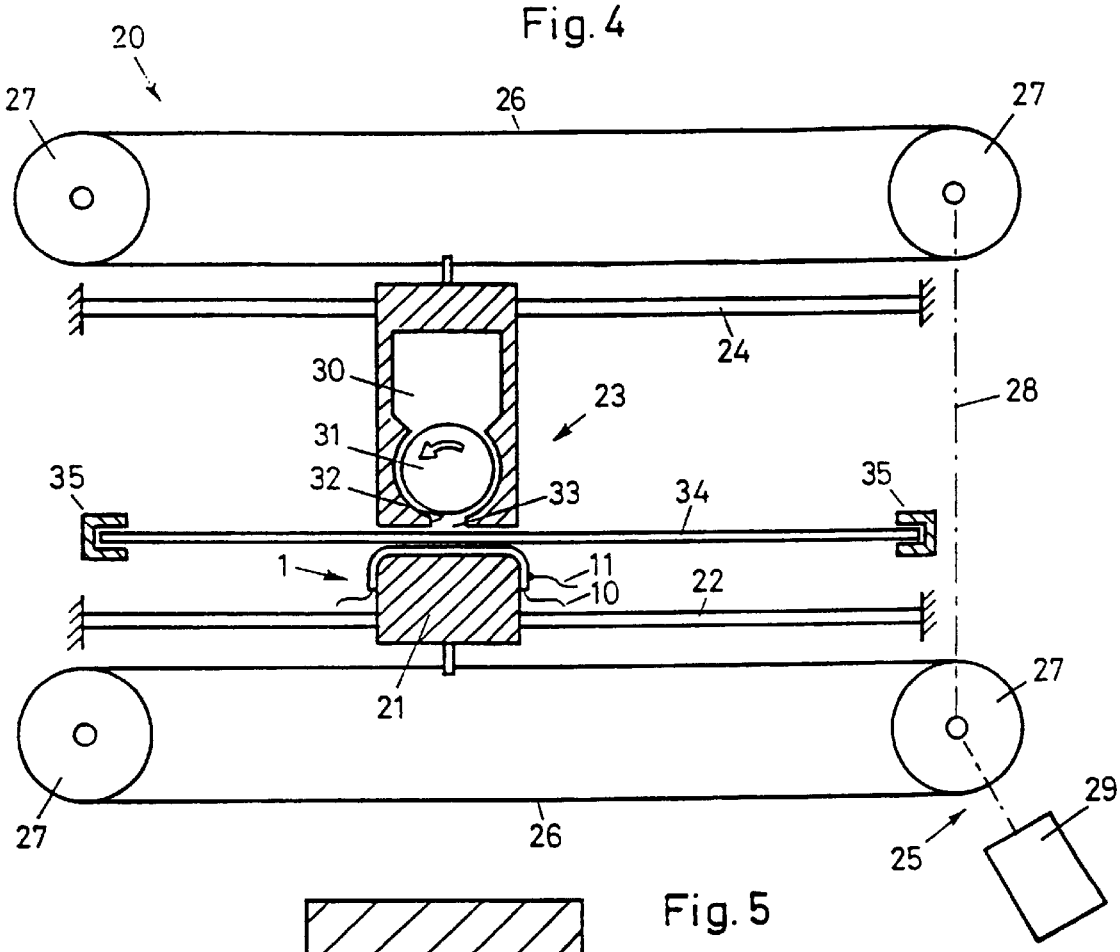
FIG. 4 shows a schematic cross-section through the contragraphy instrument of the present invention.

FIG. 4 depicts a possibility of using the electrode array in a contragraphy instrument 20. The electrode array I is positioned on a partially cylindrical basic body 21, which is movably transported on tracks 22. Above the electrode array I a developer device 23 is movable on other tracks 24. Tracks 24 are parallel to tracks 22. The developer device 23 and the basic body 21 are driven by a joint drive 25. Drive 25 is schematically indicated as two endless toothed belts 26, which are passed via toothed belt disks 27. Two of the disks 27 are connected with each other by means of a gear connection and with a servo-motor 29, so that the mutual position between the developer device 23 and the basic body 21 is constant. The developer device 23 has a storage chamber 30, filled with toner and a developer roll 31, which closes off the lower opening 32 of chamber 30. The opening 32 defines a print location 33 above the electrodes 4 of the electrode arrangement 1. Between the opening 32 and the electrode arrangement 1, an information carrier 34 is clamped, for example a piece of paper, which is symbolically indicated by two clamping units 35. The two clamping units 35 can be moved, for example, step by step, vertically vis-a-vis the plane depicted according to FIG. 4, whereby the instrument 20, between two forward feed steps, each time prints one line by moving across the width of the paper. Consequently, the required length of the electrode arrangement 1 and the number of targeted electrodes 4 is low. Cost of electronics for targeting of electrodes 4 can thus be reduced. On the other hand, it is also possible to provide for the length of the electrode arrangement 1 and the developer device 23 which is equal to the length of the paper. This, naturally, requires a greater cost expenditure in circuit electronics, but significantly increases the printing speed.

Figure 5:
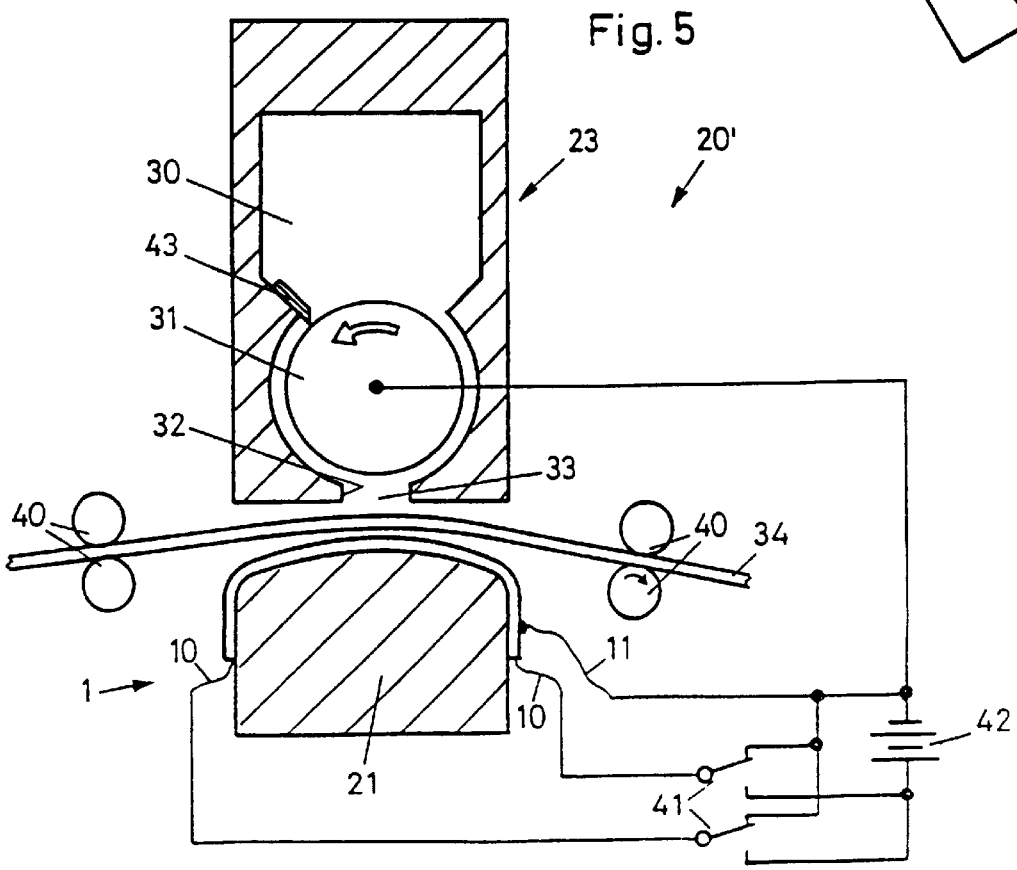
FIG. 5 shows a schematic cross-section through another specific embodiment of the instrument of the present invention.

In FIG. 5, another variation of the contragraphy instrument 20' is shown, whereby analog parts are identified with identical reference symbols, so that detailed description of these parts becomes unnecessary. In this specific embodiment, the developer device 23 and the basic body 21 are stationary with the electrode arrangement 1 and the paper 34 is passed along the printing location 33 by pairs of propelled rollers 40. The top side of the basic body 21 and thus of the electrode arrangement 1 is cylindrically convex and the paper 34 drags across the electrode arrangement 1. As a result, the geometry is accurately defined between the developer roller 31, the electrode arrangement 1 and the paper 34. The individual lines to the electrodes 4 can randomly be switched via electronic switches between two tensions, for example between the tension which is put on the developer roller 31 and another opposite tension which is generated by tension source 42. The shield grid 7 and the screening electrode 3 are placed at the tension of the developer roller 31. When in operation, the developer roller 31 rotates in the direction of the arrow and carries along, by means of static and/or magnetic forces, dosed by a blade 43, a thin toner layer. If one of the electrodes 4 is switched, through switching of the appropriate switch 41, from the indicated basic position, an electrical field develops between said electrode 4 and roller 31, through the respective opening 8 of the shield grid 7. Said field pulls electrically charged toner particles off the roller 31 and accelerates them toward the paper 34, on which they adhere. The pair of rollers 40, which is arranged downstream, is heated, so that the pattern printed on paper 34 becomes fixated.

Figure 6:
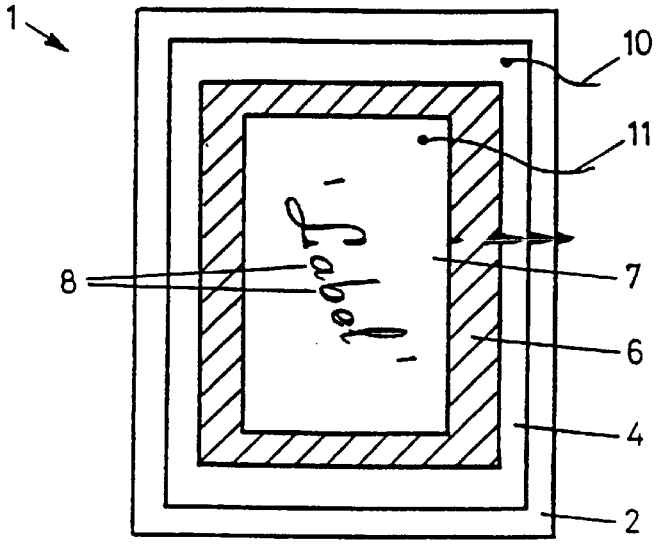
FIG. 6 shows another application of the electrode arrangement according to the present invention; and, FIG. 7 shows a contragraphy instrument with an arrangement according to FIG. 6.
Figure 7:
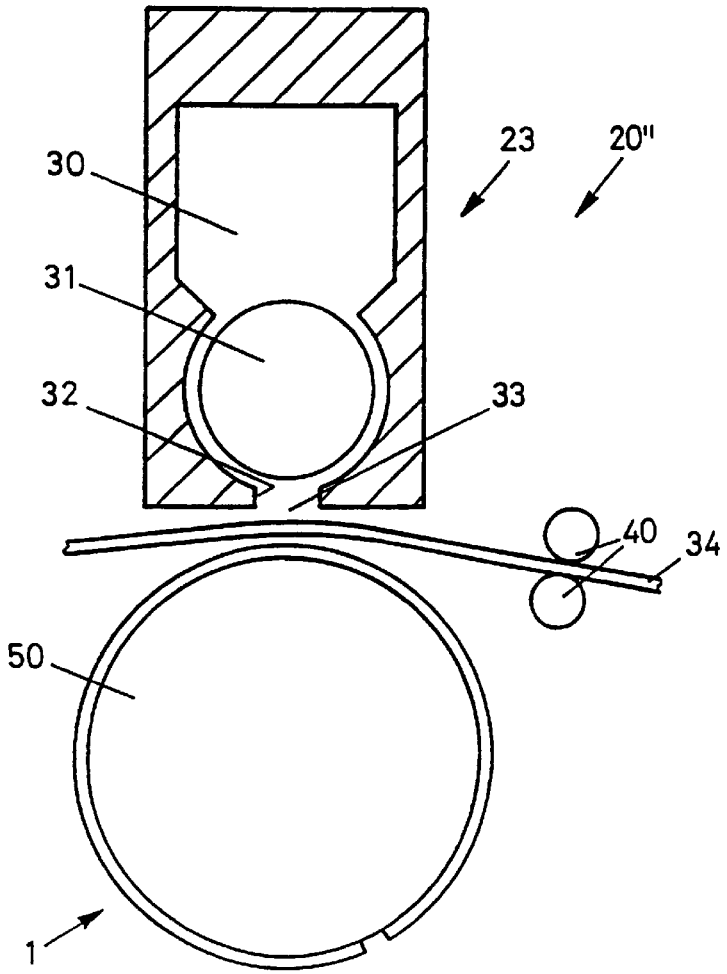

FIGS. 6 and 7 represent another specific embodiment of the invention. In this example one single, continuous, tabular electrode 4 is arranged on carrier 2. The dielectric layer 6 covers almost the entire electrode 4, but is drawn in smaller scale in FIG. 6 because of representation. The shield grid 7 covers, in turn, almost the entire dielectric layer 6 (contrary to the representation). The openings 8 can be in form of dots or in form of lines and jointly produce a printable pattern, for example a logo, —in the represented example—the word "label". The electrode arrangement 1 according to FIG. 7 is clamped on a cylindrical drum 50. The drum 50 rotates synchronous with the movement of the paper 34. If an appropriate tension is hereby put on line 10 to electrode 4, the logo is printed on paper 34 during the forward feed movement. The contragraphy instrument 20" according to FIG. 7 with the electrode arrangement according to FIG. 6 has a particularly simple design and requires a minimum in circuit expenditure.

The invention has been described with reference to a preferred embodiment thereof. Obviously, modifications and alterations will occur to others upon a reading and understanding of this specification. It is intended to include all such modifications and alterations insofar as they come within the scope of the appended claims or the equivalents thereof.

Having thus described the invention, I hereby claim:

1. An electrode arrangement for contragraphy printing using electrically charged pigment particles, the arrangement comprising:

at least one electrode connected with a conductor;

a dielectric carrier upon which the electrode is tabularly arranged as a metal layer;

a dielectric intermediate layer covering the electrode; and, a shield grid arranged as a thin metal layer above the intermediate layer, the shield grid defining at least one opening having a free area above the electrode, the electrode extending unobstructed over an area greater than the free area of the opening.

2. The arrangement according to claim 1, further comprising a multitude of electrodes with one conductor each arranged on the dielectric carrier and wherein the shield grid above each electrode defines an opening.

3. The arrangement according to claim 2, wherein the electrodes and the conductors are shielded against each other by a shielding electrode arranged in the same plane.

4. The arrangement according to claim 3, wherein the shielding electrode is a single, large-area metal layer.

5. The arrangement according to claim 1, wherein the carrier is a flexible foil of a dielectric material placed on a cylindrical basic body and wherein connections to the conductors are located outside a printing zone.

6. A contragraphy instrument comprising:

an electrode arrangement including at least one electrode connected with a conductor, a dielectric carrier upon which the electrode is tabularly arranged as a metal layer, a dielectric intermediate layer covering the electrode and a shield grid arranged as a thin metal layer above the intermediate layer, the shield grid defining at least one opening having a free area above the electrode, the electrode extending unobstructed over an area greater than the free area of the opening;

a developer device for conducting electrostatically charged pigment particles next to the electrode;

a supply device for passing an information carrier between the developer device and the electrode arrangement.

7. The instrument according to claim 6, wherein the developer device and the electrode arrangement are stationary and the information carrier is moved during the printing process by a feeder device.

8. The instrument according to claim 7, wherein the information carrier is dragged across the electrode arrangement.

9. The instrument according to claim 6, wherein the information carrier is held stationary by clamping units during the process and the electrode arrangement and the developer device are jointly moved.

* * * * *